US006571480B1

(12) United States Patent
Qiu

(10) Patent No.: US 6,571,480 B1
(45) Date of Patent: Jun. 3, 2003

(54) PENCIL SHARPENER FOR CARPENTER'S PENCIL

(75) Inventor: Jianping Qiu, Hangzhou (CN)

(73) Assignee: Royal International Corp., Montreal (CA)

( * ) Notice: Subject to any disclaimer, the term of this patent is extended or adjusted under 35 U.S.C. 154(b) by 0 days.

(21) Appl. No.: 10/051,109

(22) Filed: Jan. 22, 2002

(51) Int. Cl.[7] ..... B43L 23/08

(52) U.S. Cl. ..... 30/457; 30/451; 30/452; 30/456

(58) Field of Search ..... 30/451, 457, 458, 30/459, 452, 456, 461

(56) References Cited

U.S. PATENT DOCUMENTS 1,281,747 A * 10/1918 Allen ..... 30/456
5,040,256 A * 8/1991 Mills ..... 30/451
5,167,071 A * 12/1992 Eisen ..... 30/452
6,092,293 A * 7/2000 Donaldson ..... 30/457
6,279,238 B1 * 8/2001 Gillson ..... 30/456
6,338,198 B1 * 1/2002 Rolls ..... 30/452

* cited by examiner

*Primary Examiner*—Hwei-Siu Payer
(74) *Attorney, Agent, or Firm*—Ogilvy Rennault; Guy J. Houle

(57) ABSTRACT

A hand-operable and portable pencil sharpener which is comprised of a housing having a conical cavity therein. The cavity is of circular cross-section and defines an open inlet end tapering to a narrow inner end. A collar is provided about the open inlet end and formed integral with the housing. A pencil centering insert is rotatably secured in the collar by a flexible and removable snap ring. A slot is provided along the side wall of the conical cavity and a blade having a,sharp edge is secured adjacent to the slot with the sharp edge projecting slightly into the cavity whereby to shave a portion of the wood and lead on the extremity of a carpenter's pencil rotated in the conical cavity and centered by a centering slot in the pencil centering insert. An abrading element is secured to the housing to permit the abrading of a sharp point on the end of the lead.

9 Claims, 3 Drawing Sheets

PENCIL SHARPENER FOR CARPENTER'S PENCIL

TECHNICAL FIELD

The present invention relates to a hand-operable and portable pencil sharpener for use by tradespeople such as carpenters for sharpening a carpenter's pencil.

BACKGROUND ART

In the prior art, the most important of which is exemplified by U.S. Pat. No. 6,092,293, there is described a carpenter's pencil sharpener of the type as described in the present application. A disadvantage of that specific pencil sharpener is that the blade, which is secured next to the slot, whereby to cut an exposed point on the pencil lead, is curved and, accordingly, the material of the blade is constantly under stress and can break during use, rendering the device inoperable. Another disadvantage is that the centering collar is snap-fitted within a resilient track disposed inwardly in a base enclosure whereby to allow rotation of the collar relative to the base about a central axis. Once the collar is fitted within the resilient track, it is not removable therefrom and, if any debris or dust enters the resilient track, it can cause the centering collar to jam, rendering the sharpener unusable. A still further major disadvantage of the sharpeners is that they do not sharpen the extremity of the lead to a fine point, as the lead is of rectangular cross-section. When the pencil is rotated, shavings of the wood about the pointed end and both side edge portions of the lead only are cut. This leaves the extremity of the lead blunt and in most cases the pencil cannot inscribe fine lines, which is important when inscribing certain marks on material pieces to be cut or machined.

SUMMARY OF INVENTION

It is a feature of the present invention is provide a hand-operable and portable pencil sharpener which substantially overcomes the above-mentioned disadvantages of the prior art.

According to the above feature, from a broad aspect, the present invention provides a hand-operable and portable pencil sharpener which comprises a housing having a conical cavity therein. The cavity is of circular cross-section and defines an open inlet end tapering to a narrow inner end. A collar is provided about the open inlet end and formed integral with the housing, and defines a circular cavity concentric with the open inlet end. A pencil centering insert is provided in close rotational fit within the circular cavity and rotatable therein. The pencil centering insert has a pencil centering slot. Removable attachment means is provided for retaining the pencil centering insert in the circular cavity. A longitudinal through slot is provided along a side wall of the conical cavity. A flat straight blade having a sharp longitudinal edge is secured adjacent to the longitudinal through slot, with the sharp longitudinal edge projecting into the cavity whereby to shave a portion of the extremity of a pencil rotated in the conical cavity and centered by the centering slot of the pencil centering insert.

According to a still further broad aspect of the present invention, there is provided a pencil lead abrading element secured to the housing to abrade a fine point on the free end of a lead of a pencil.

BRIEF DESCRIPTION OF DRAWINGS

A preferred embodiment of the present invention will now be described with reference to the accompanying drawings, in which.

DESCRIPTION OF PREFERRED EMBODIMENTS

Figure 1:
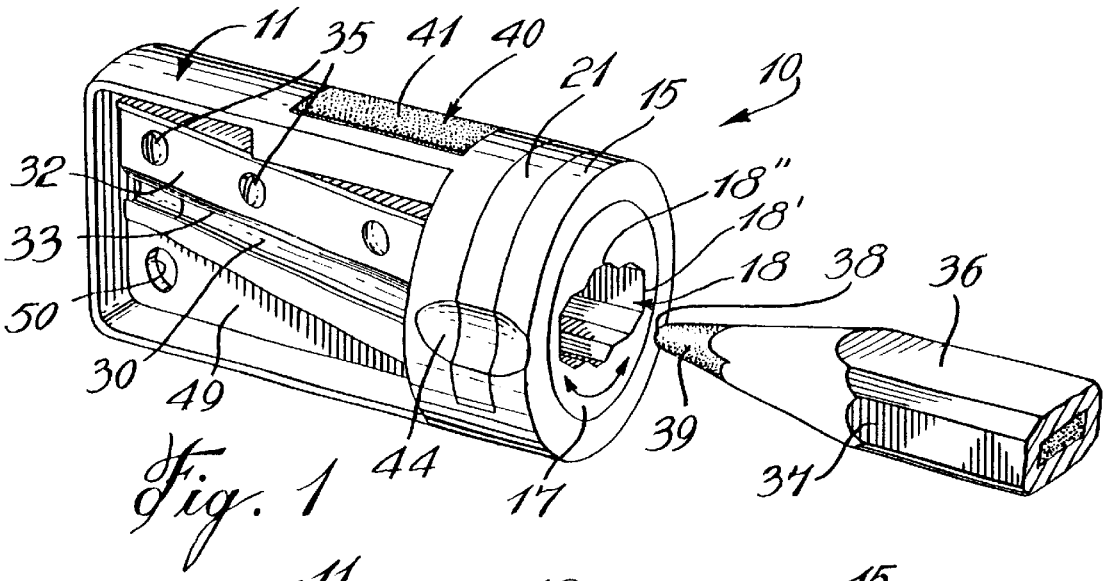
FIG. 1 is a perspective view of the hand-operable and portable pencil sharpener of the present invention.
Figure 2:
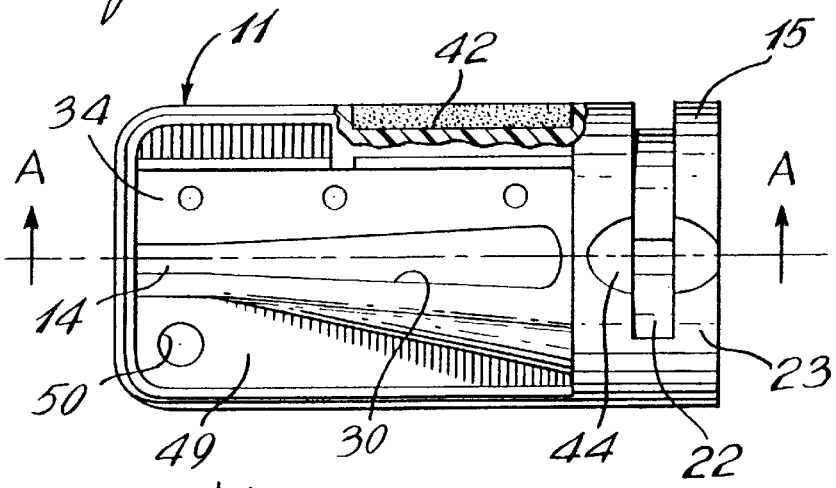
FIG. 2 is a side view, partly in section, of the housing of the pencil sharpener.
Figure 3:
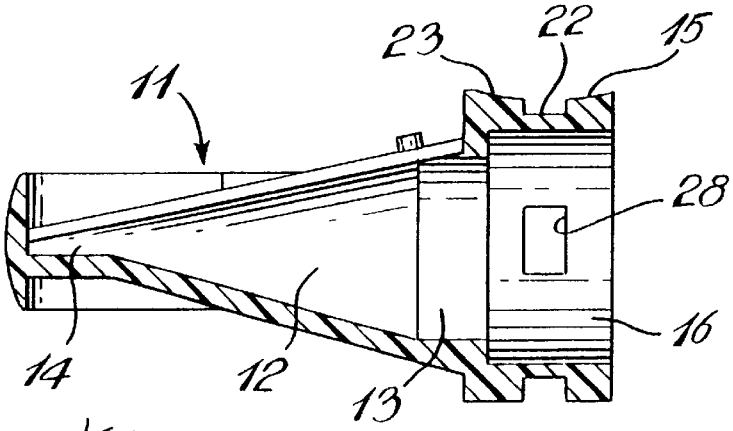
FIG. 3 is a section view along section lines A—A of FIG. 2.
Figure 4:
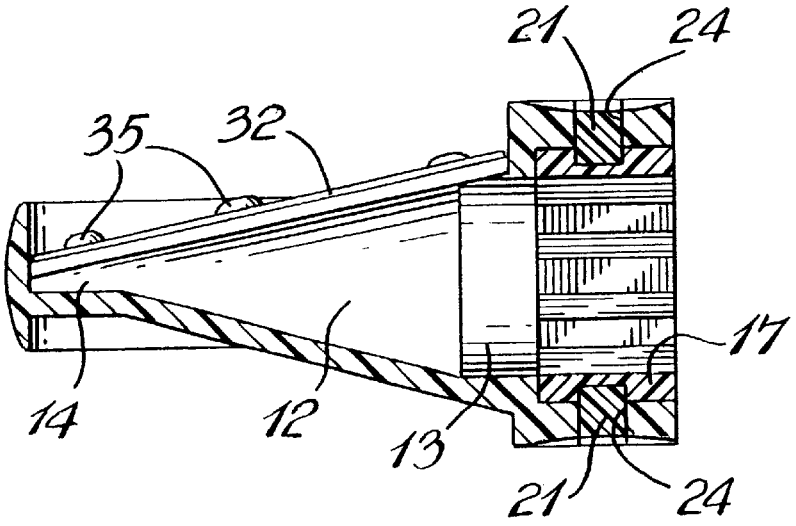
FIG. 4 is a section view similar to FIG. 3, but including the assembly of the pencil centering insert and the flexible plastic clip.

Referring now to the drawings, and more particularly to FIGS. 1 to 5, there is shown generally at 10 the hand-operable and portable pencil sharpener of the present invention. It comprises a housing 11 having a conical cavity 12 therein, as better illustrated in FIGS. 3 and 4. The conical cavity is of circular cross-section and defines an open inlet end 13, tapering to a narrow inner end 14. A collar 15 is formed integral with the housing and defines a circular cavity, which is concentric with the open inlet end 13. The housing, as shown in FIG. 3, is molded from a suitable plastics material.

Figure 6A:
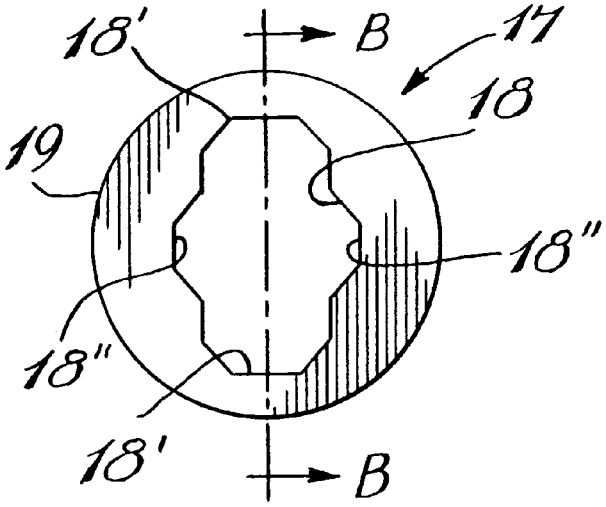
FIG. 6A is an end view of the pencil centering insert showing the configuration of the transverse slots.
Figure 6B:
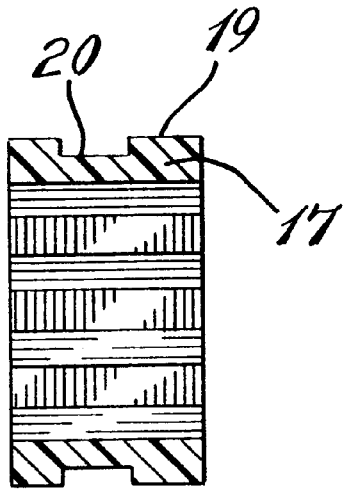
FIG. 6B is a section view along section lines B—B of FIG. 6A.

Referring to FIGS. 6A and 6B, there is shown a pencil centering insert, which is also molded of plastic material. It is formed as a ring having a pencil centering slot 18, which extends through the annular insert 17, as shown in FIG. 6B. The insert has a circular outer surface 19 containing a circumferential channel 20.

Figure 7:
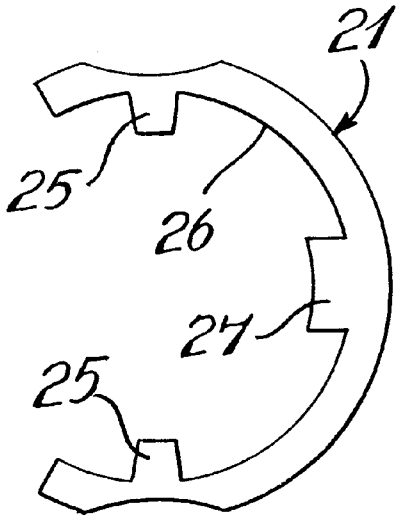
FIG. 7 is a side view of the flexible plastic clip showing the configuration thereof.

The pencil centering insert 17 is received in close rotational fit within the circular cavity of the collar 15 and retained therein by a removable attachment means in the form of a flexible plastic clip 21, as illustrated in FIG. 7. As shown in FIGS. 2 and 3, the collar 15 is provided with a clip-receiving channel 22, which is formed in the outer surface 23 of the collar. The channel has at least two spaced-apart through holes 24 (see FIG. 4) for receiving a respective one of a pair of teeth 25 projecting from the inner surface 26 of the clip 21. As can be seen in FIG. 7, the clip is a U-shaped clip formed by a cut-out portion of a plastic ring. The clip also has a locating projection 27 which protrudes into a locating through hole 28 (see FIG. 3) for centering the clip 21. In order to secure the pencil centering insert 17 in the collar 15, the insert is positioned within the collar and the flexible plastic clip 21 is pressed over the clip-receiving channel 22 with the locating projection 27 disposed within the locating through hole 28 and the teeth 25 enter into their respective through holes 24. Accordingly, the insert is removably secured within the circular cavity and freely rotatable therein. To remove the insert, it is merely necessary to remove the flexible plastic clip.

Referring again to FIGS. 1 and 2, it can be seen that a longitudinal through slot 30 is formed along a side wall of the conical cavity 12. A flat straight sharpening blade 32, having a sharp longitudinal edge 33, is secured adjacent to the longitudinal through slot 30 on a fastening wall 34 by means of fasteners 35. The sharp longitudinal edge 33 of the blade projects slightly into the cavity 12 whereby to shave a portion of the wood and lead on the extremity of a pencil 36, which is placed in the pencil centering slot 18 and pushed to abut the side wall of the cavity adjacent to the blade cutting edge and rotated with respect to the housing 11. The pencil is held in one hand and the housing or the pencil is rotated one with respect to the other. Accordingly, an outer end surface 37 of the pencil 36 is cut or shaved to sharpen the end edges of the lead 39. However, the sharpener leaves a blunt end 38 at the end of the pencil lead 39. In order to provide a sharp point at the end of the lead, there is provided a pencil lead abrading element 40 secured to the housing and having an exposed abrading surface 41 for abrading a fine point on or along the free end or blunt end 38 of the lead 39. Therefore, the blunt end 38 can be sharpened to have a sharp point.

Figure 5:
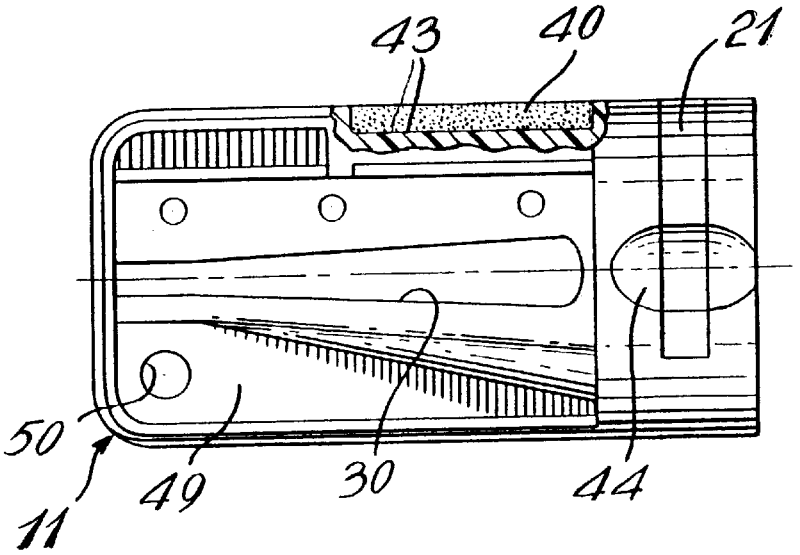
FIG. 5 is a side view similar to FIG. 2 but showing the abrading material piece secured in the cavity formed in the side wall of the housing to abrade a fine point on the free end of a lead of a carpenter's pencil.

As shown in FIGS. 2 and 5, the abrading element 40 is an abrading stone piece of rectangular cross-section which is secured within a cavity 42 formed in the housing 11. The stone piece 40 is secured within the cavity by glue 43.

As shown in FIG. 1, finger locating depressions 44 are formed in an outer surface of the collar 15 and disposed on opposed sides thereof for comfort in clamping the housing between the fingers of a user person. As also shown in FIGS. 1 and 6A, the pencil centering slot 18 is of substantially rectangular cross-section and, as herein shown, there are two slots positioned transverse with one another, with the first slot 18' being longer than the second slot 18", whereby to provide close fit for carpenter's pencils of different widths. Also, the ends of the slot have an octagonal shape to fit the contour of the pencils, which are usually octagonal in cross-section. A hole 50 is provided in a flat wall 49 of the housing for attaching the pencil sharpener to a cord or chain.

It is within the ambit of the present invention to cover any obvious modifications of the preferred embodiment described herein, provided such modifications fall within the scope of the appended claims.

What is claimed is:

1. A hand-operable and portable pencil sharpener comprising a housing having a conical cavity therein, said cavity being of circular cross-section and defining an open inlet end tapering to a narrow inner end, a collar about said open inlet end and formed integral with said housing and defining a circular cavity concentric with said open inlet end, a pencil centering insert in close rotational fit within said circular cavity and rotatable therein, said pencil centering insert having a pencil centering slot, removable attachment means for retaining said pencil centering insert in said circular cavity, a longitudinal through slot along a side wall of said conical cavity, a flat straight blade having a sharp longitudinal edge secured adjacent to said longitudinal through slot with said sharp longitudinal edge projecting into said conical cavity whereby to shave a portion of the extremity of a pencil rotated in said conical cavity and centered by said centering slot of said pencil centering insert.

2. A hand-operable and portable pencil sharpener as claimed in claim 1 wherein there is further provided a pencil lead abrading element secured to said housing and having an exposed abrading flat surface for abrading a sharp point on a free end of a lead of a carpenter's pencil.

3. A hand-operable and portable pencil sharpener as claimed in claim 2 wherein said abrading element is an abrading stone piece secured in a cavity formed in said housing.

4. A hand-operable and portable pencil sharpener as claimed in claim 3 wherein said abrading stone piece is glued within said cavity formed in said housing, said cavity extending co-axially with a longitudinal axis of said housing.

5. A hand-operable and portable pencil sharpener as claimed in claim 2 wherein opposed finger locating depressions are formed in an outer surface of said collar for receiving fingers of a user.

6. A hand-operable and portable pencil sharpener as claimed in claim 2 wherein said pencil centering slot is of substantially rectangular cross-section for receiving a carpenter's pencil in close fit therethrough.

7. A hand-operable and portable pencil sharpener as claimed in claim 6 wherein a transverse slot is formed across said pencil centering slot at mid-length thereof, said transverse slot being of a shorter length to receive a pencil of shorter width therethrough.

8. A hand-operable and portable pencil sharpener as claimed in claim 1 wherein said removable attachment means is a flexible plastic clip removably secured in a clip receiving channel formed in an outer surface of said collar, said channel having at least two spaced-apart through holes for receiving a respective one of a pair of teeth projecting from said clip, said teeth extending through said holes and into a circumferential channel formed about an outer wall of said pencil centering insert to retain said insert rotatably captive in said circular cavity while permitting rotation therein.

9. A hand-operable and portable pencil sharpener as claimed in claim 4 wherein said clip is a U-shaped clip, said clip receiving channel extending in a portion of the circumference of said collar.

* * * * *